US008028869B2

(12) United States Patent
Rossaki

(10) Patent No.: US 8,028,869 B2
(45) Date of Patent: Oct. 4, 2011

(54) ADJUSTABLE CLOTHES HANGER

(76) Inventor: Torsak Rossaki, Bethesda, MD (US)

( * ) Notice: Subject to any disclaimer, the term of this patent is extended or adjusted under 35 U.S.C. 154(b) by 360 days.

(21) Appl. No.: 12/289,972

(22) Filed: Nov. 7, 2008

(65) Prior Publication Data

US 2009/0120974 A1 May 14, 2009

Related U.S. Application Data

(60) Provisional application No. 60/996,314, filed on Nov. 9, 2007.

(51) Int. Cl.
*A41D 27/22* (2006.01)

(52) U.S. Cl. ..... 223/94; 223/89

(58) Field of Classification Search ..... 223/61, 223/68, 69, 74, 85, 89, 90, 92, 94, 71, 88
See application file for complete search history.

(56) References Cited

U.S. PATENT DOCUMENTS

| | | | | |
|---|---|---|---|---|
| 877,226 | A | | 1/1908 | Timberlake |
| 1,818,193 | A | * | 8/1931 | Burde ..... 223/88 |
| 2,060,395 | A | * | 11/1936 | Irwin et al. ..... 223/69 |
| 2,213,975 | A | | 9/1940 | Burwell |
| 2,539,895 | A | * | 1/1951 | Cuneo et al. ..... 223/69 |
| 2,634,030 | A | * | 4/1953 | Hershberger ..... 223/74 |
| 2,746,657 | A | * | 5/1956 | Feathers ..... 223/69 |
| 2,929,538 | A | * | 3/1960 | Douglass ..... 223/69 |
| 2,958,447 | A | | 11/1960 | Rouseau |
| 3,596,386 | A | | 8/1971 | Zapater |
| D246,218 | S | | 11/1977 | Goodman |
| 4,673,114 | A | | 6/1987 | Douglas |
| 5,476,199 | A | | 12/1995 | Halverson et al. |
| 5,680,972 | A | | 10/1997 | Clarke |
| D411,374 | S | | 6/1999 | Kilian et al. |
| 6,068,166 | A | | 5/2000 | Kilian et al. |
| 6,688,503 | B2 | | 2/2004 | Viazanko et al. |
| D488,309 | S | | 4/2004 | Atwood |
| 6,722,538 | B1 | | 4/2004 | Autry et al. |

FOREIGN PATENT DOCUMENTS

| | | |
|---|---|---|
| GB | 2278540 | 12/1994 |
| JP | 2003-251097 | 9/2003 |

OTHER PUBLICATIONS

Website, http://www.improvementscatalog.com/home/improvements/792912101-expandable-hangers.html, expandable hangers, one sheet printed from the internet on Aug. 5, 2007.

* cited by examiner

*Primary Examiner* — Gary L Welch
*Assistant Examiner* — Nathan Durham
(74) *Attorney, Agent, or Firm* — Richard C. Litman

(57) ABSTRACT

The adjustable clothes hanger has adjustable sleeve upper stays, sleeve lower stays, and torso side stays. These components adjust to spread the sleeves and torso of a shirt on the hanger to hold the fabric in a smooth, lightly stretched condition to optimize drying and preclude wrinkling. The hanger has opposed sleeve upper stays, which adjust along the underlying frame of the hanger. The outer portions of the sleeve upper stays extend to support the shirtsleeve upper edges. Torso side stays extend downwardly from the horizontal crossmember of the hanger, and adjust to hold the sides of the shirt apart and to hold the torso fabric in a smooth and unwrinkled condition during drying. Pivotal or fixed sleeve lower stays may extend from the upper portions of the torso side stays, or may extend adjustably from the outer ends of the adjustable sleeve upper stays.

21 Claims, 16 Drawing Sheets

ADJUSTABLE CLOTHES HANGER

CROSS-REFERENCE TO RELATED APPLICATION

This application claims the benefit of U.S. Provisional Patent Application Ser. No. 60/996,314, filed Nov. 9, 2007.

FIELD OF THE INVENTION

The present invention relates generally to garment hangers, and particularly to an adjustable clothes hangar having various adjustable components thereon in order to hold the shape of a shirt or the like to reduce or eliminate wrinkles in the fabric.

DESCRIPTION OF THE RELATED ART

The basic concept of the clothing hanger has been known for a considerable period of time, from the provision of simple wall mounted pegs for holding coats and the like above the floor. The simple wire, plastic, or wood frame hanger having a relatively wide triangular configuration with sloping shoulder supports and a central hook, was developed somewhat later to provide more compact storage of clothing by hanging a closely spaced series of such hangers on a horizontal crossmember in a closet or the like.

The problem with such relatively simple hangers is that they do not provide any shaping of an article of clothing placed thereon, other than some limited support of the shoulders in the case of the conventional triangular wood, plastic, or wire frame hanger. This may have been sufficient for virtually all articles of clothing in the past, excepting some of the most sophisticated and formal garments, but today all but the most casual wear is generally expected to be smooth and wrinkle-free. While the development of so-called "wrinkle-free" fabrics have been a significant aid in providing clothing which is easy to care for, such fabrics still require a fair amount of care in order to avoid excessive wrinkles and to provide a neat appearance for the wearer.

This is even more so with certain high-end shirts and similar clothing. Many people enjoy the feel of natural cotton fiber, yet also desire a satin-like luster or sheen in their high-end fabrics and clothing. As a result, natural cotton yarns and threads have been developed which have very fine gauge or denier, with manufacturers using the Mercerizing process to impart additional sheen to the fabric. Such very finely woven fabric with its Mercerizing treatment is quite costly, with top of the line golf and polo shirts sometimes costing well over one hundred dollars each. Obviously, the owners of such garments wish to take very good care of their clothing and avoid undue wear and tear and damage during cleaning and storage.

Accordingly, the typical care label provided with such high-end shirts and the like cautions the owner to "flat dry" their garments, i.e., avoid the use of an automatic dryer with its high heat, and lay the garments out flat on a suitable surface. The reason for this is that such garments are generally susceptible to shrinkage when exposed to high heat, as in a clothes dryer. Hanging such garments out to dry avoids the shrinkage problem, but does little to avoid wrinkling. Thus, the owner must still have the shirts ironed after washing and drying, which adds further to the cost and time involved in owning and caring for such fine clothing.

Yet, the "flat dry" technique of drying such garments leaves something to be desired, as well. Most homes do not have a suitable area for flat drying clothing, with the clothing articles being laid out atop furniture, bedding, tables, etc. Obviously, this renders the furniture and other surfaces unusable during the time that the clothing is drying, and oftentimes upholstered furniture imparts some undesirable odor to the clothing as a result of the damp clothing resting directly atop the furniture. Solid wood furniture does not readily absorb and transfer odors, but it is susceptible to absorbing moisture from damp articles placed thereon, thereby staining or ruining the finish of the article of furniture.

Various attempts have been made in the past to solve this problem of properly drying expensive and delicate garments. An example of such is found in Japanese Patent No. 2003-251,097, published on Sep. 9, 2007. This publication describes (according to the drawings and English abstract) a clothes hanger with an air permeable material installed thereover. The garment is placed on the hanger over the air permeable sheet, which prevents the front and back of the garment from clinging to one another while they are still damp.

Thus, an adjustable clothes hanger solving the aforementioned problems is desired.

SUMMARY OF THE INVENTION

The adjustable clothes hanger provides different embodiments of a garment hanger having shoulder supports with adjustable sleeve upper stays thereon, and sleeve lower stays and torso side stays. These various stays and components may be adjusted to spread the sleeves and torso of a shirt placed on the hanger, to hold the fabric in a smooth, lightly stretched condition to optimize drying and preclude wrinkling. Each embodiment includes opposed sleeve upper stays, which are adjustable along the underlying shoulder supports of the hanger frame. The outer portions of the sleeve upper stays extend to support the upper edges of the shirtsleeves. Torso side stays extend downwardly from the horizontal crossmember of the hanger, and may be adjusted to hold the sides of the shirt apart from one another and to hold the torso fabric in a smooth and unwrinkled condition during drying. Sleeve lower stays may extend from the upper portions of the torso side stays in one embodiment, or may extend adjustably from the outer ends of the adjustable sleeve upper stays in another embodiment. Various components may fold for compact storage.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
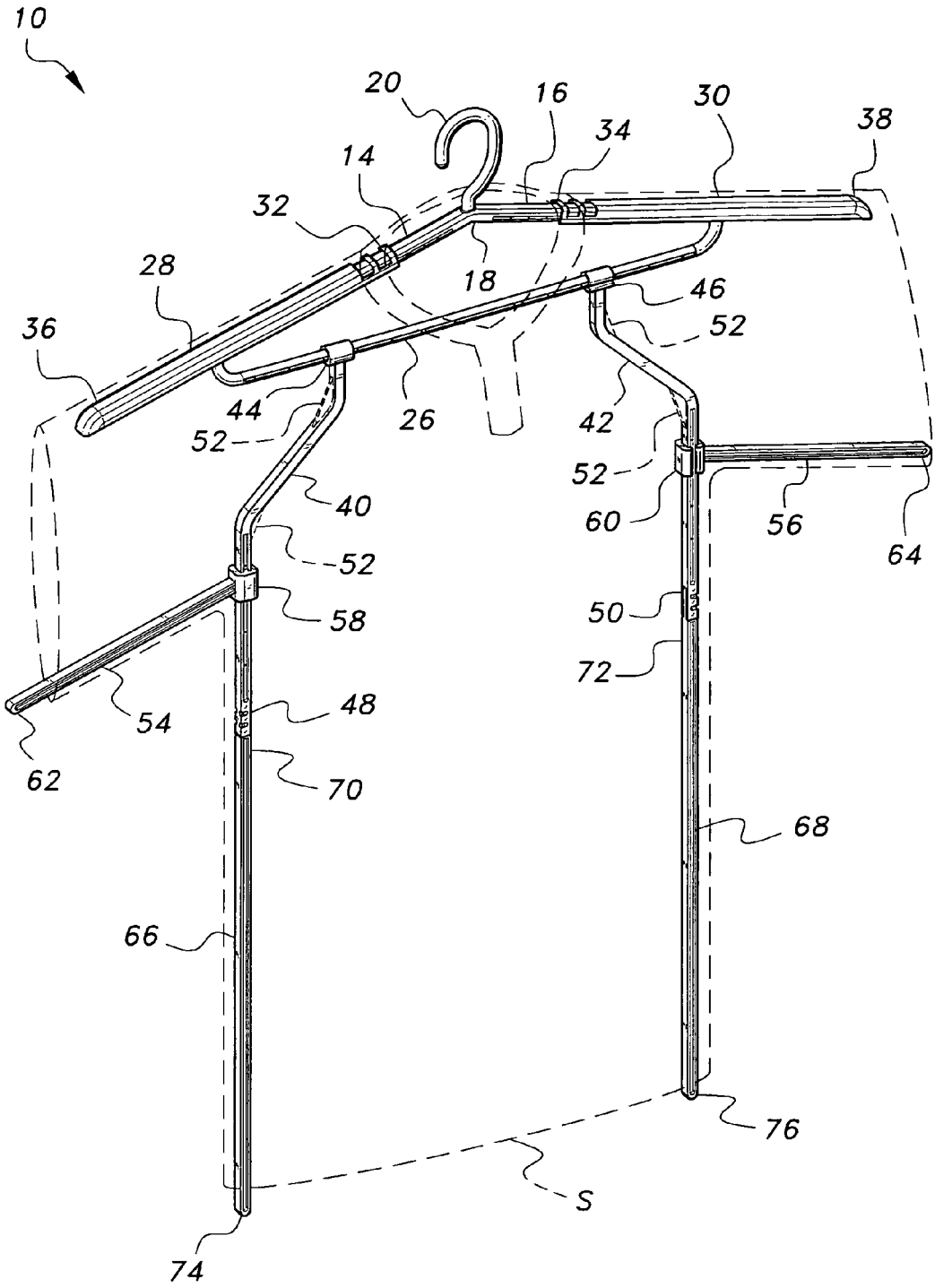
FIG. 1 is a perspective view of a first embodiment of the adjustable clothes hanger according to the present invention, with a shirt illustrated thereon in broken lines.
Figure 2:
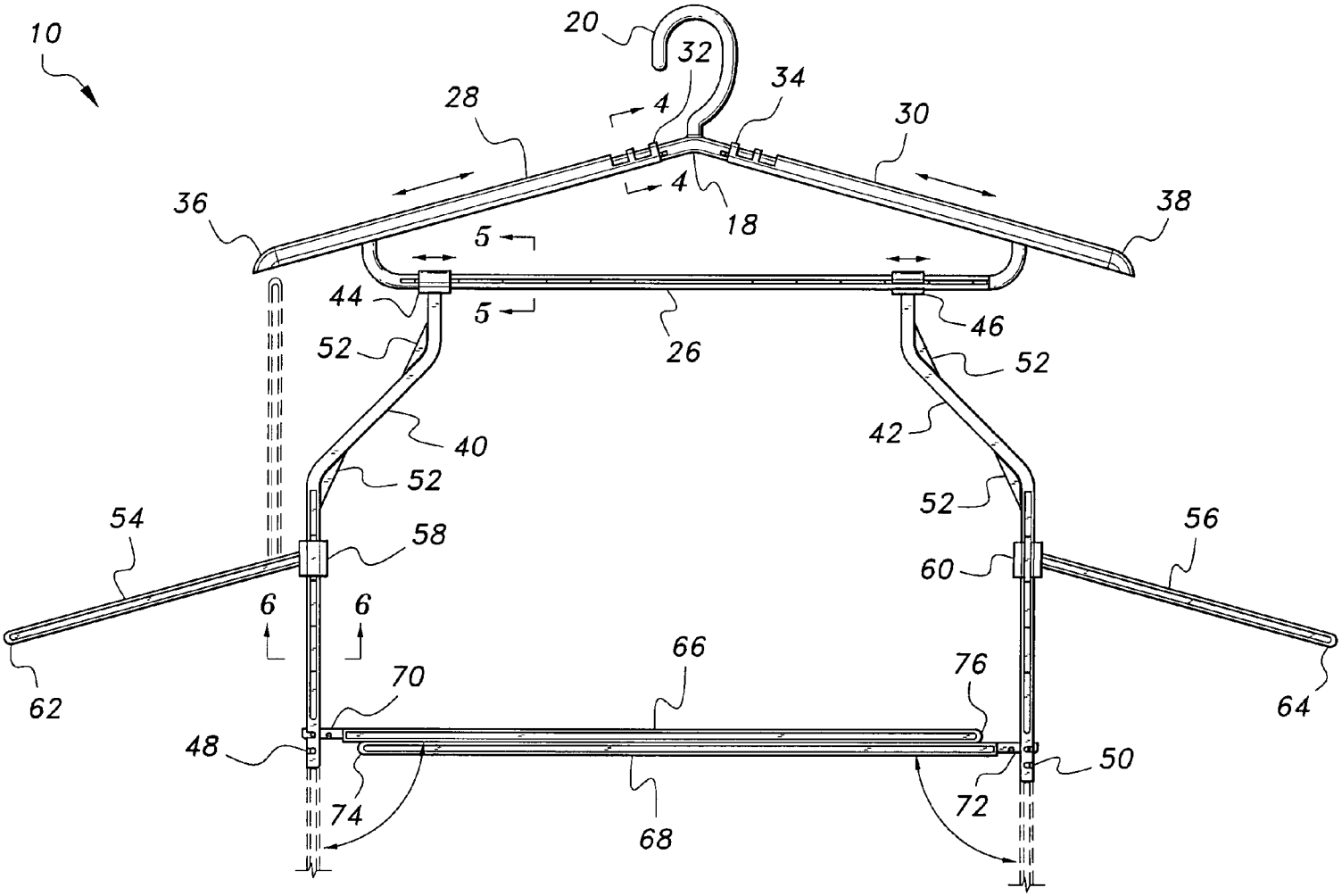
FIG. 2 is a front elevation view of the adjustable clothes hanger of FIG. 1, showing the adjustment and folding of various components.
Figure 3:
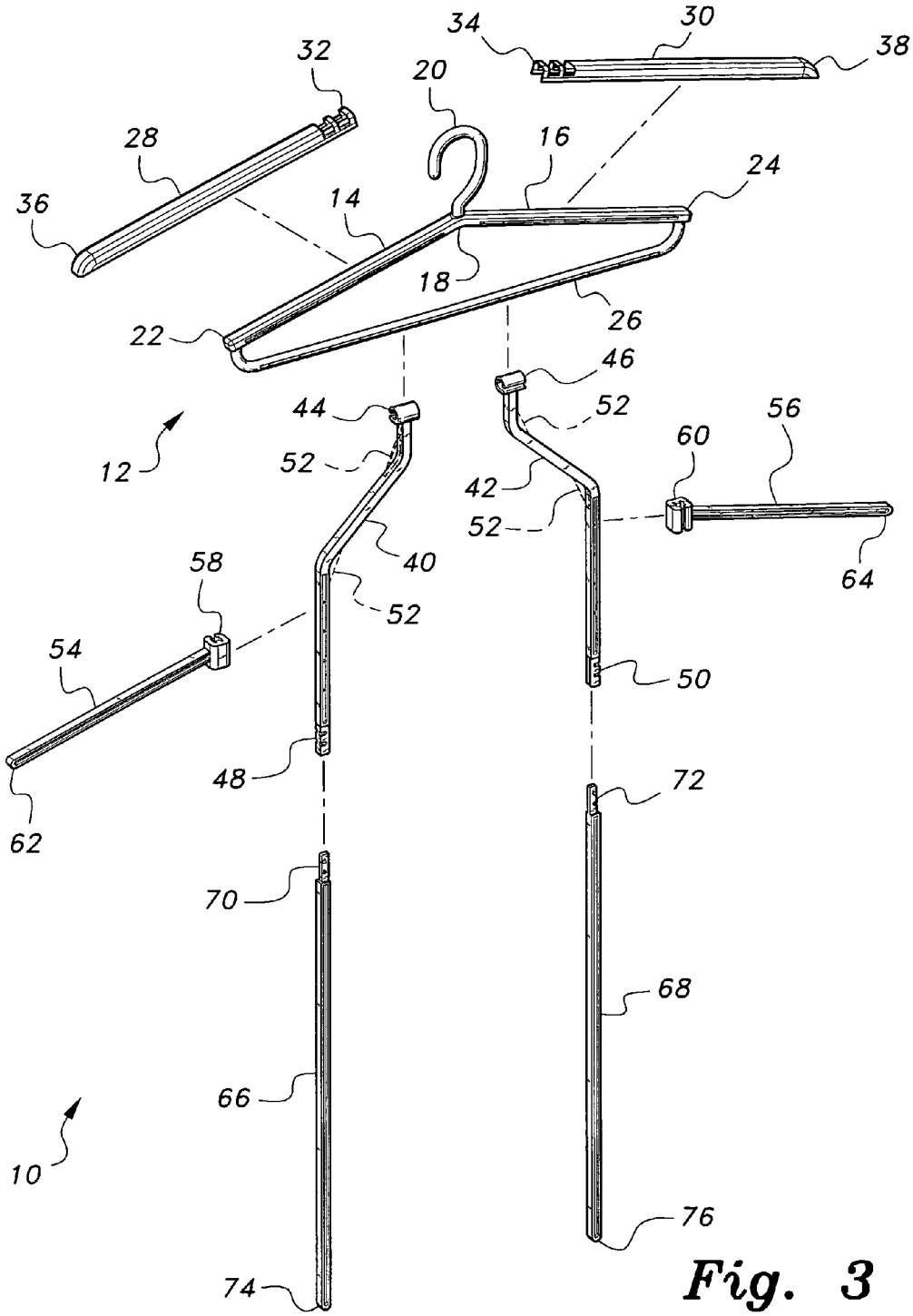
FIG. 3 is an exploded perspective view of the adjustable clothes hanger of FIGS. 1 and 2, showing the assembly of the various components to one another.

The present invention comprises various embodiments of an adjustable clothes hanger, with the various adjustments providing for the spreading and light stretching of the fabric of a shirt or similar garment to reduce or eliminate wrinkling during final drying. FIGS. 1 through 3 of the drawings provide various views of a first embodiment 10 of the hanger, with FIGS. 4 through 7 providing details of the various adjustable components. The adjustable hanger 10 includes a frame 12 formed of mutually opposed first and second shoulder supports, respectively 14 and 16, most clearly shown in FIG. 3. The two shoulder supports have a common central end 18, with a hanger hook 20 extending therefrom. Each of the shoulder supports 14 and 16 slopes downwardly and outwardly to a distal end, respectively 22 and 24, opposite their common central end 18. A horizontal crossmember 26 connects the two distal ends 22 and 24 of the shoulder supports 14 and 16 with one another to complete the frame 12, which has a relatively low and wide triangular configuration generally similar to other conventional clothes hangers.

First and second sleeve upper stays, respectively 28 and 30, are adjustably installed upon the respective first and second shoulder supports 14 and 16. These two sleeve upper stays 28 and 30 and their underlying shoulder supports 14 and 16 include means for retaining the stays on the shoulder supports and locking their positions thereon, illustrated in FIG. 4 and described in detail further below. Each of the sleeve upper stays 28 and 30 has an inner or inboard end, respectively 32 and 34, and an opposite distal outboard end, respectively 36 and 38. The two sleeve upper stays 28 and 30 slide coaxially along their respective shoulder supports 14 and 16, to extend or retract their distal ends 36 and 38 laterally for the support of the upper side or portions of the sleeves of a shirt S placed upon the adjustable hanger 10. It will be seen that the sleeve upper stays 28 and 30 have sufficient length to support at least a portion of the shoulders of the shirt S, as well as extending outwardly into the sleeves, but the sleeve upper stays 28 and 30 are designated as such in order to differentiate them from the fixed shoulder supports 14 and 16 of the hanger frame 12.

First and second lower stay arms, respectively 40 and 42, have generally semicylindrical crossmember attachment ends or fittings, respectively 44 and 46, which adjustably attach to the crossmember 26 as explained further below. The two lower stay arms 40 and 42 are preferably identical to one another, but secure to the crossmember 26 from opposite sides thereof to produce the substantially mirror image, mutually outwardly bowed assembly shown in FIGS. 1 through 3 of the drawings. Each lower stay arm 40 and 42 has a distal end, respectively 48 and 50, providing for the attachment of first and second torso stays thereto as shown in the various drawing Figs. and described in detail further below. The opposite ends of each of the two lower stay arms 40 and 42 are preferably axially offset from one another in order to spread the lower portion with its distal end farther outward from its attachment end, in order to better spread the torso of the shirt S by means of the torso stays depending therefrom as described further below. A reinforcement web 52 may be provided at each angular bend of the lower stay arms 40 and 42, to strengthen the two stay arms. These reinforcement webs are optional, and are accordingly shown in solid or broken lines in various drawing Figs. and omitted in others. They may be incorporated or omitted in any of the embodiments, as desired.

Figure 6:
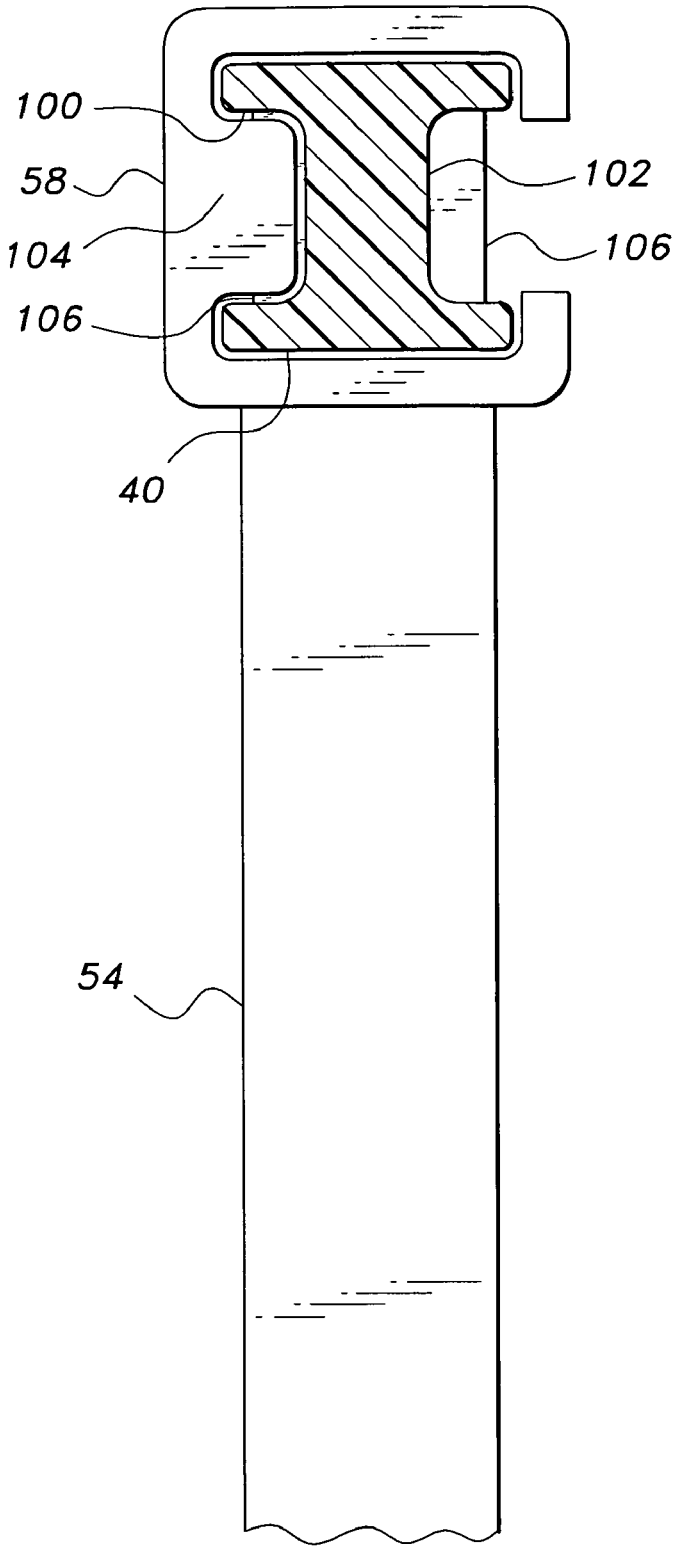
FIG. 6 is a section view along lines 6-6 of FIG. 2.

Each of the two lower stay arms 40 and 42 has a sleeve lower stay, respectively 54 and 56, adjustably attached thereto and extending therefrom. The two sleeve lower stays 54 and 56 are identical to one another, but attach to and extend from their respective lower stay arms 40 and 42 in opposite, substantially mirror image deployment, similarly to the installation of the two identical lower stay arms 40 and 42 upon the crossmember 26. Each of the sleeve lower stays 54 and 56 includes a lower stay arm attachment end, respectively 58 and 60, slidably and adjustably installed upon the respective lower stay arm, and an opposite distal end, respectively 62 and 64. Details of the sleeve lower stay attachment to the lower stay arm are shown in FIG. 6 and described in detail further below. The two sleeve lower stays 54 and 56 are adjustable upwardly and downwardly along their respective lower stay arms 40 and 42, and extend substantially parallel to their respective first and second sleeve upper stays 28 and 30. In this manner, the sleeve lower stays may be raised or lowered to adjust for the widths of the shirtsleeves placed thereon, to spread them for proper drying and to greatly reduce or eliminate the formation of wrinkles in the shirtsleeves.

Figure 7:
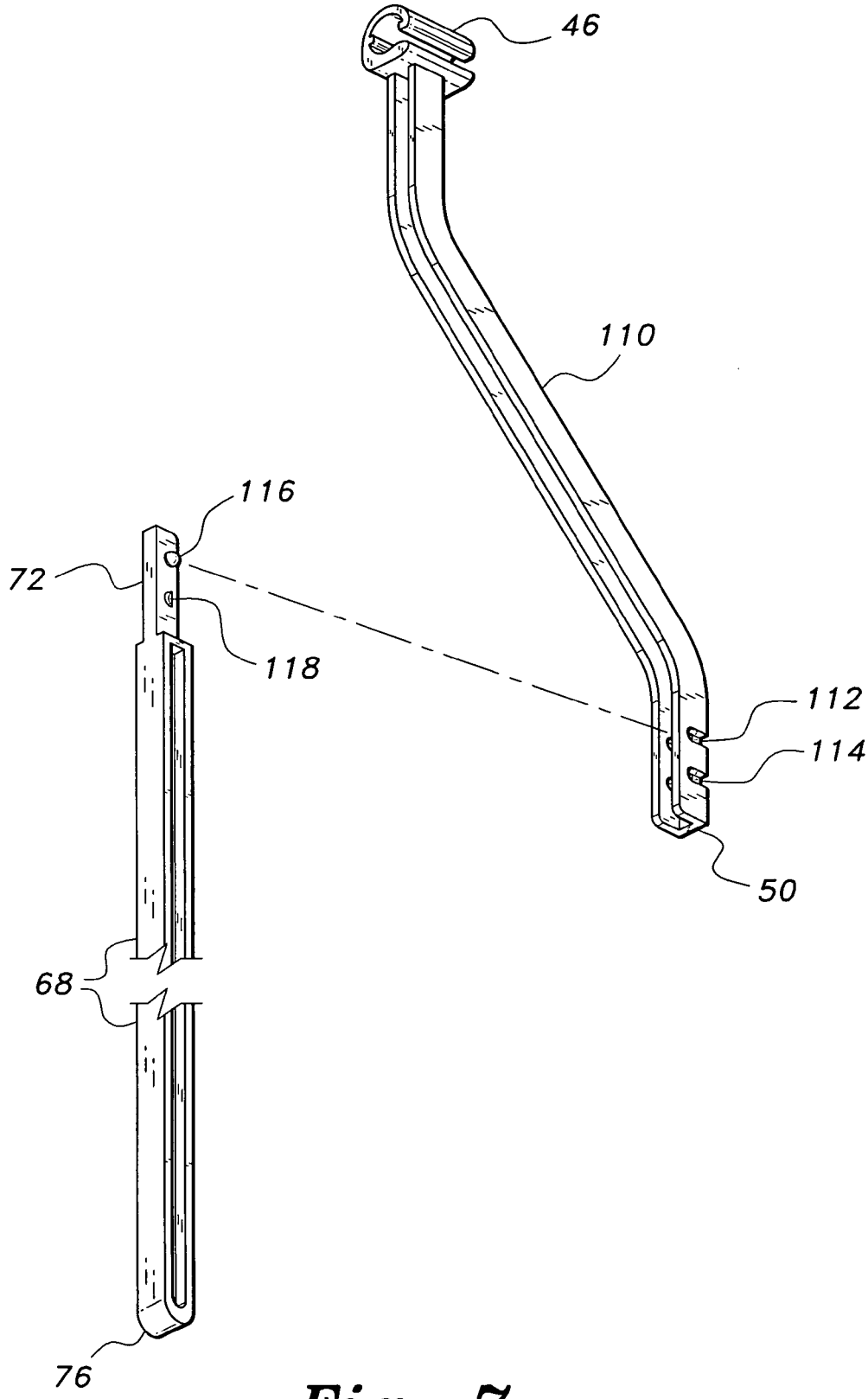
FIG. 7 is an exploded perspective view of an adjustable clothes hangar according to the present invention, illustrating details of the assembly of the lower torso stay to the upper torso stay.

Each of the lower stay arms 40 and 42 further includes a torso stay, respectively 66 and 68, attached to and extending from its distal end 48 and 50. Each torso stay includes a lower stay arm attachment end, respectively 70 and 72, and an opposite distal end, respectively 74 and 76. The torso stays are preferably sufficiently long to extend completely along the sides of the torso of a shirt S to spread the torso for drying and to eliminate or reduce wrinkling. Preferably, each of the torso stays 66 and 68 is pivotally attached to its respective lower stay arm 40 and 42, to allow the torso stays to be folded for compact storage of the hanger 10 as shown in FIG. 2 of the drawings. The specific pivotal attachment structure of the torso stays to their respective lower stay arms is illustrated in FIG. 7, and described in detail further below.

Figure 4:
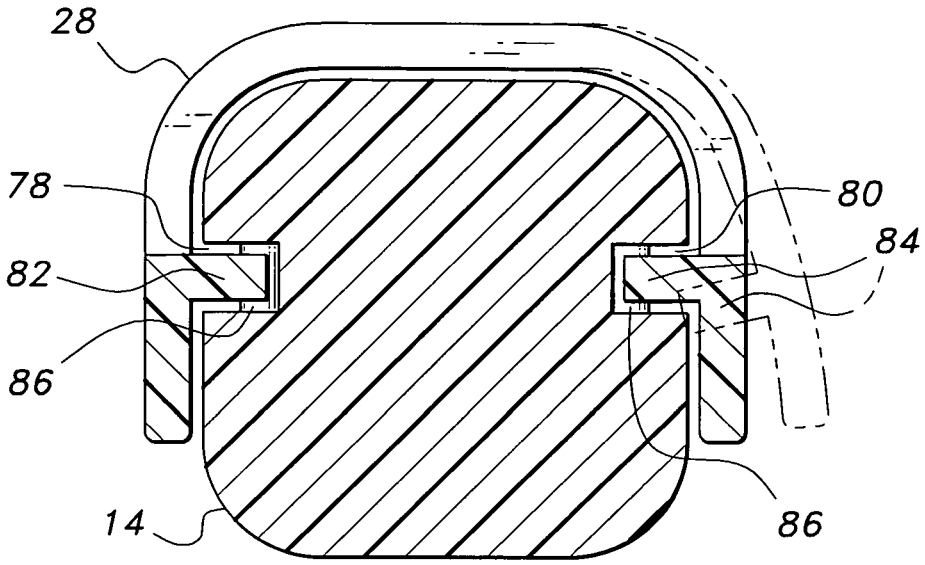
FIG. 4 is a section view along lines 4-4 of FIG. 2.

FIGS. 4 through 7 illustrate details of the adjustable attachment of various components to one another. FIG. 4 is a view in section through line 4-4 of FIG. 2, showing details of the adjustable attachment of the first sleeve upper stay 28 to its mating first shoulder support 14. It will be understood that the opposite second sleeve upper stay 30 attaches to its second shoulder support 16 in an essentially identical manner. The shoulder support 14 includes opposed first and second longitudinal channels, respectively 78 and 80, with the opposite edges of the corresponding sleeve upper stay 28 having inwardly extending tabs, respectively 82 and 84, which engage the corresponding channels 78 and 80. The tabs 82 and 84 retain the sleeve upper stay 28 on the shoulder support 14, yet allow the sleeve upper stay to slide longitudinally along the shoulder support to adjust the span of the sleeve upper stays 28 and 30 as desired. The sleeve upper stays are held in position along their respective shoulder supports by a series of detents 86 disposed within either or both of the channels 78 and 80 of the shoulder supports 14 and 16. The sleeve upper stays 28 and 30, as well as other components of the hanger 10, are preferably formed of a plastic material which provides sufficient strength and rigidity to hold the shape of the device and a shirt S placed thereon, yet provides sufficient flexibility to allow the edges of the sleeve upper stays to be spread for the tabs 82 and 84 to pass over the detents 86 for adjustment, or to withdraw the tab(s) 82 and/or 84 from their corresponding channel(s) 78 and/or 80 to install or remove the sleeve upper stays 28 and 30 from their corresponding shoulder supports 14 and 16, as shown in broken lines in FIG. 4.

Figure 5:
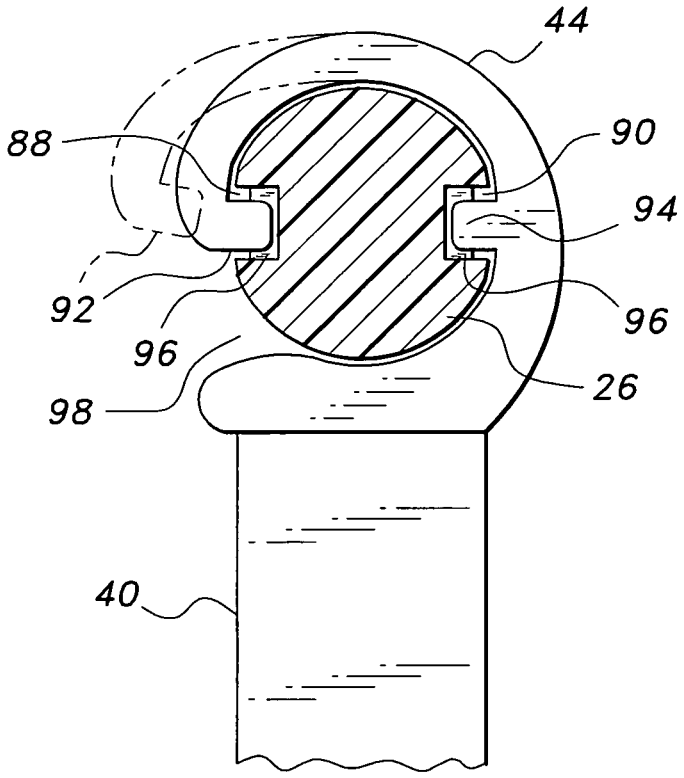
FIG. 5 is a section view along lines 5-5 of FIG. 2.

FIG. 5 is a cross sectional view of the crossmember 26 and the crossmember attachment end fitting 44 of the first lower stay arm 40 as seen through line 5-5 of FIG. 2. The crossmember 26 includes opposed first and second longitudinal channels, respectively 88 and 90, formed therein, with the attachment end fitting 44 comprising an approximately ¾ semicircular section surrounding the majority of the circumference of the crossmember 26. The opposite lower stay arm 42 and its crossmember attachment end fitting 46 are essentially identical to the first lower stay arm 40 and its attachment fitting 44, but the orientation would be reversed when viewed from the same direction as shown in FIG. 5. The attachment end fitting 44 includes opposed first and second tabs 92 and 94 extending inwardly therefrom, which engage the corresponding channels 88 and 90 of the crossmember 26. A series of detents 96 is provided within at least one of the two channels 8 and 90, to hold the position of the attachment end fitting 44 (and thus the lower stay arm 40 extending therefrom) as desired along the length of the crossmember 26. The gap 98 in the attachment end fitting 44 allows the fitting to be flexed and spread (s shown in broken lines in FIG. 5) for the tabs 92 and/or 94 to pass over the detents 96 in the channel(s) 88 and/or 90 for positional adjustment of the lower stay arm on the crossmember, and/or for the installation or removal of the attachment end fitting 44 to or from the crossmember 26 as desired.

FIG. 6 is a view in section of the attachment end 58 of the first sleeve lower stay 54 and the lower portion of the first lower stay arm 40 to which it is adjustably attached, as seen from line 6-6 of FIG. 2. This configuration is essentially a mirror image of the corresponding second components 42 and 60. The lower portion of the lower stay arm 40 (and its counterpart 42) has a generally I-beam shaped cross section, with the opposite webs defining opposed first and second channels 100 and 102 therein. The lower stay arm attachment end fitting 58 has a corresponding internal shape, generally in the form of a somewhat squared C-shape cross section with one open side. The edges of the C-shape extend around the edges of the lower stay arm 40 to hold the attachment end fitting 58 (and its sleeve lower stay 54) on the lower stay arm and allow the fitting 58 and corresponding stay 54 to slide along the length of the lower portion of the lower stay arm 40. Although the non-circular cross sectional shapes of the lower portion of the lower stay arm and the attachment end fitting 58 preclude rotation of the two components relative to one another, the attachment end fitting of the sleeve lower stay is provided with an inwardly extending tab 104. This tab 104 engages the various spaced apart detents 106 disposed within the opposite channels 100 and 102, depending upon the orientation of the installation of the attachment fitting 58 on the sleeve lower stay 54, to hold the attachment fitting (and its corresponding sleeve lower stay) in place along the lower stay arm as desired. The attachment fitting 58 may be distended and spread to release the engagement of the inwardly extending tab 104 with the corresponding detent 106 and/or for the installation or removal of the fitting and its sleeve lower stay from the lower stay arm, generally as described for the adjustment, installation, or removal of the sleeve upper stays from their shoulder supports and the crossmember attachment fittings of the lower stay arms from the crossmember, as shown in FIGS. 4 and 5 and described further above.

FIG. 7 provides an exploded perspective view to show the pivotal attachment of the lower torso stay to the distal end of the corresponding lower stay arm. It will be noted that the second or right side lower stay arm 110 illustrated in FIG. 7 is somewhat different from the lower stay arms 40 and 42 of the first embodiment hanger assembly 10 of FIGS. 1 through 3, in that it is shorter and has a generally U-shaped cross section along its entire length. This lower stay arm configuration is used with the third embodiment hanger assembly 310 illustrated in FIGS. 9 through 12.

Figure 8:
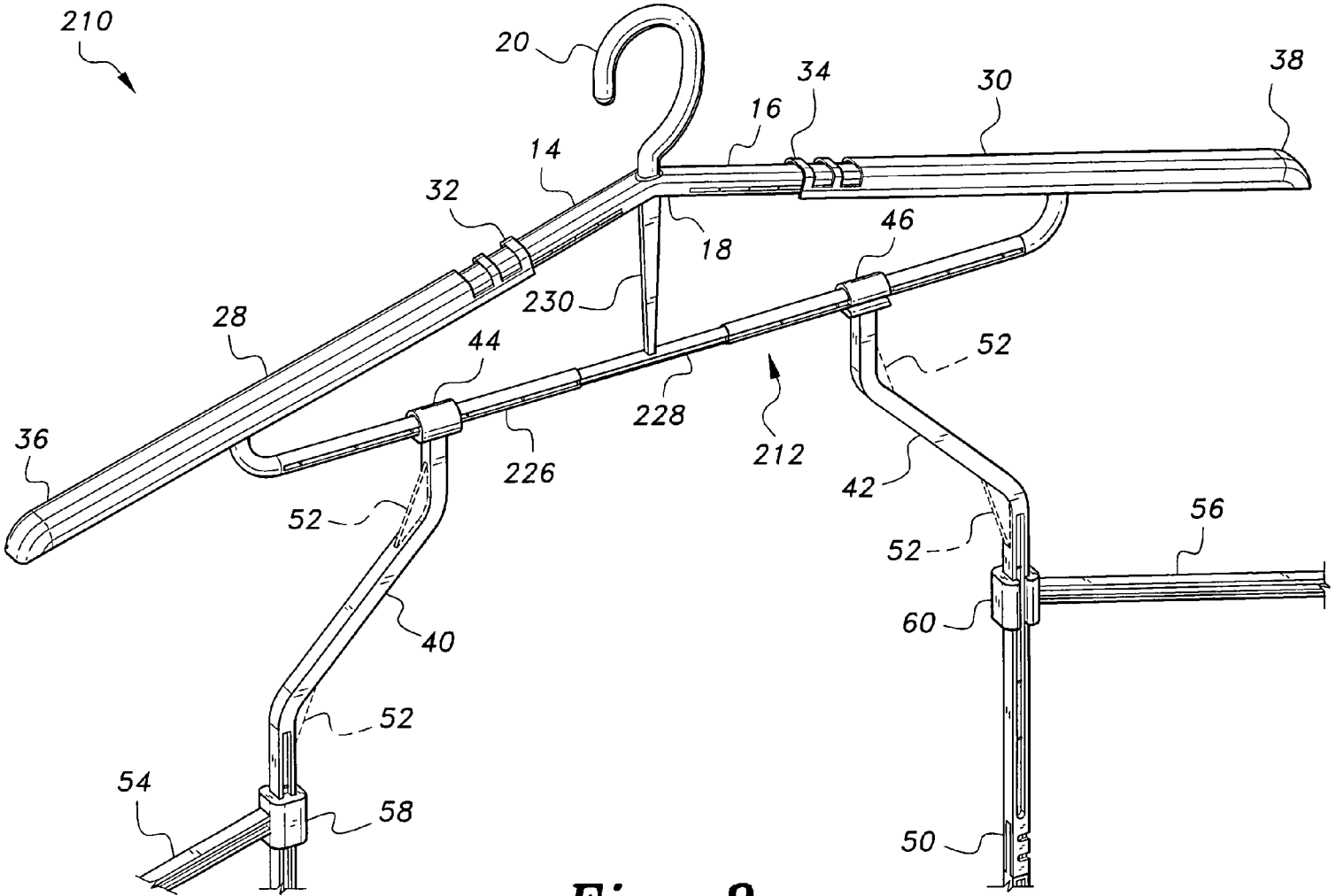
FIG. 8 is a perspective view of a second embodiment of an adjustable clothes hanger, illustrating various details thereof.

However, the U-shaped cross section of the distal end 50, and the opposite crossmember attachment end fitting 46, are identical to those components 46 and 50 of the second or right side lower stay arm 42 shown in the first embodiment of FIGS. 1 through 3 and the second embodiment of FIG. 8 and accordingly have identical reference numerals. The U-shaped cross section of the distal end 50 of the lower stay arm 110 of FIG. 7 (and other lower stay arms 42) includes laterally disposed first (pivot pin) and second (latch pin) slots 112 and 114 across the base or closed side thereof. These slots 112 and 114 accept corresponding pivot pins 116 and latch pins 118, which extend laterally from opposite sides of the attachment end 72 of the second torso stay 68.

Figure 9:
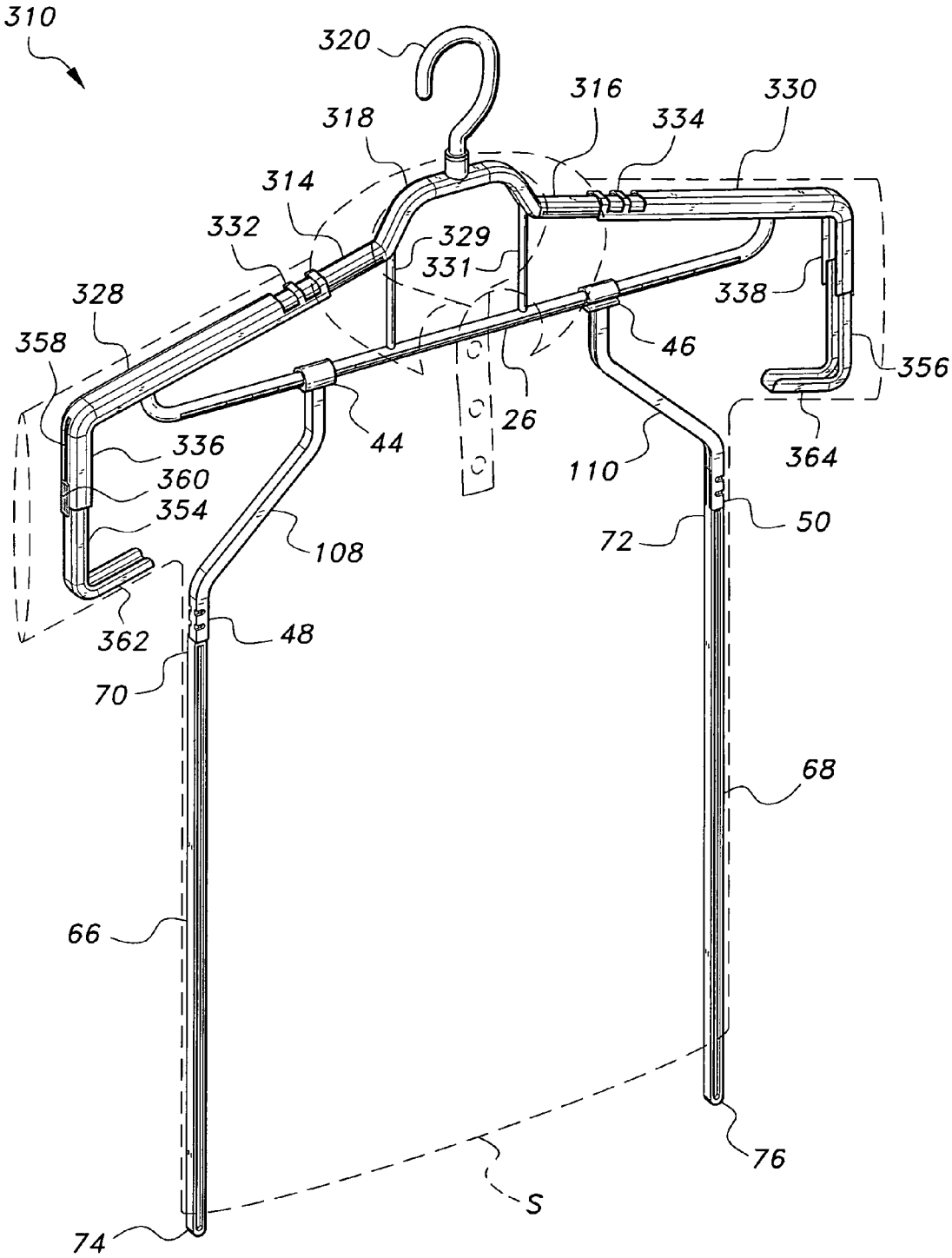
FIG. 9 is a perspective view of a third embodiment of an adjustable clothes hanger according to the present invention, with a shirt illustrated thereon in broken lines.
Figure 10:
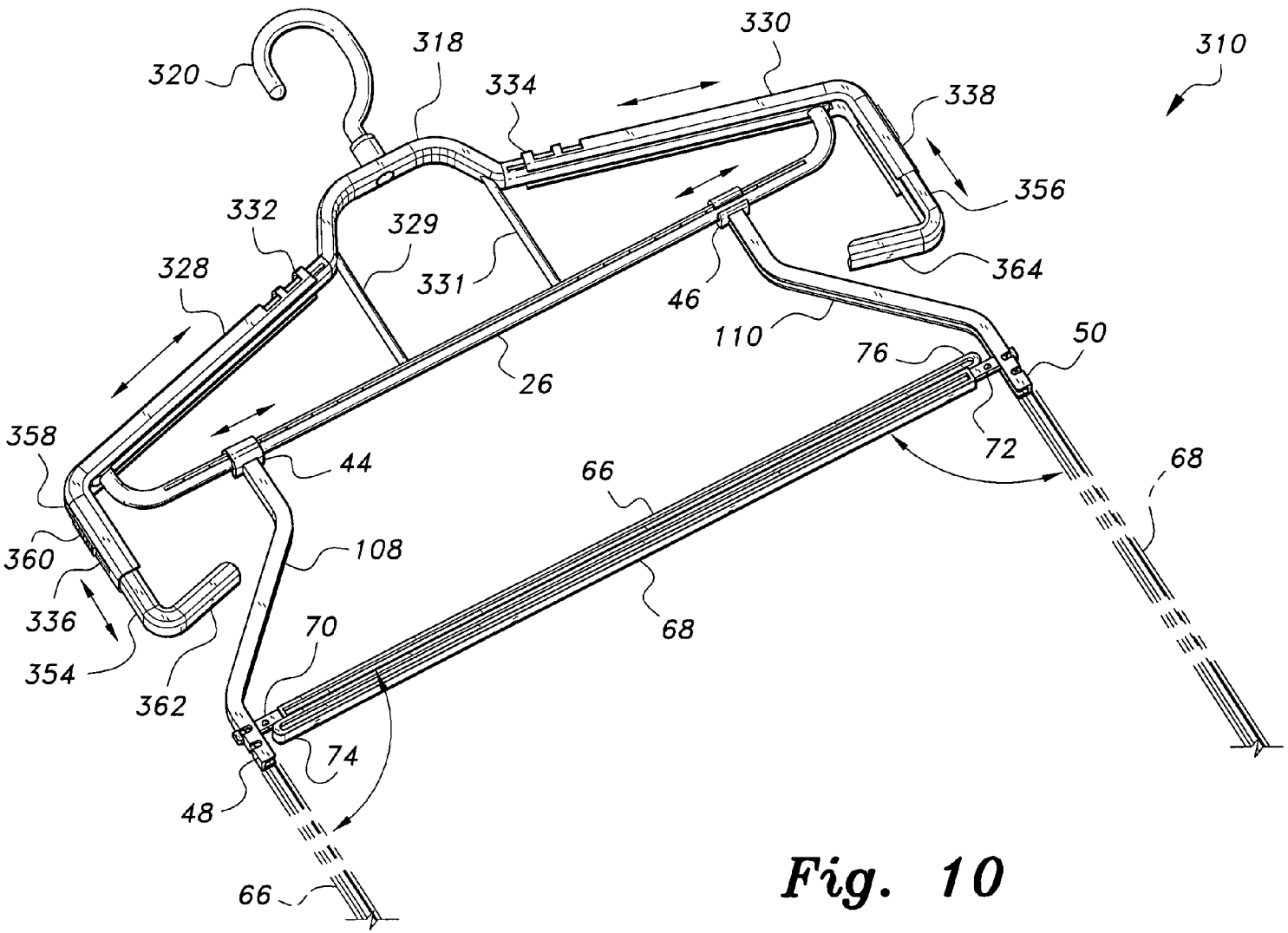
FIG. 10 is a perspective view of the adjustable clothes hanger embodiment of FIG. 9, showing the adjustment and folding of various components.
Figure 11:
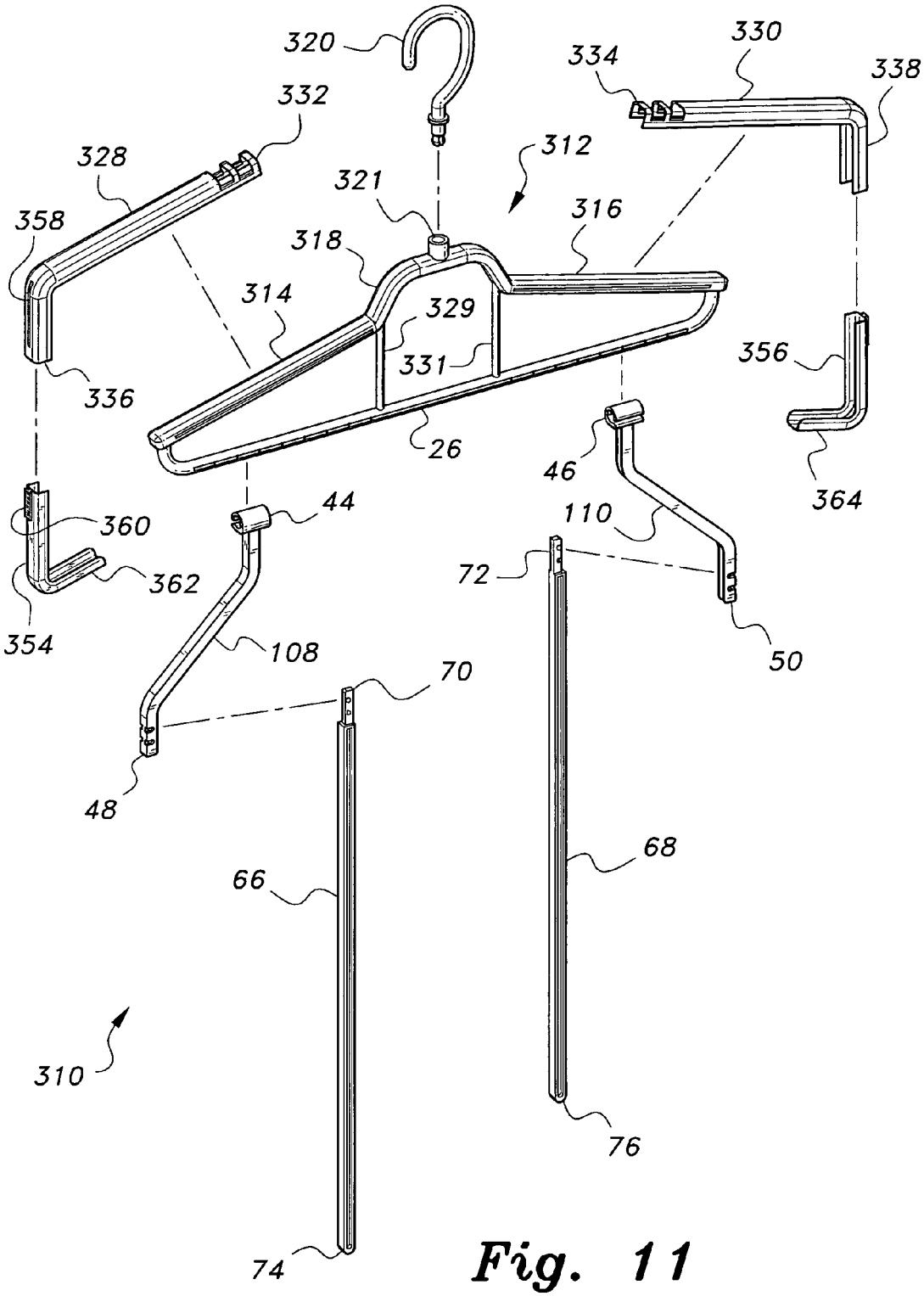
FIG. 11 is an exploded perspective view of the adjustable clothes hanger of FIGS. 9 and 10, showing the assembly of the various components to one another.

The pivot pins 116 are slightly longer than the latch pins 118, and tend to secure the torso stay 68 pivotally to the corresponding distal end 50 of the lower stay arm 110 (or the identical end 50 of a lower stay arm 42). The latch pins 118 are preferably tapered to one side, enabling those latch pins 118 to slide between the opposite walls of the U-shaped distal end 50 of the lower stay arm to lock the torso stay 68 in its extended position axially aligned with the lower end or portion of the lower stay arm to which it is attached, as shown in FIGS. 1 and 9. Yet, pivoting the torso stay 68 inwardly forces the two latch pins 118 to pass between the corresponding sides of the U-section distal end 50 of the lower stay arm to allow the lower stay arm to pivot upwardly to a folded configuration, as shown in FIGS. 2 and 10 of the drawings.

The somewhat flexible plastic material of which the components of the adjustable clothes hanger are formed, allow for the distension or spreading of the two opposite sides of the U-section distal end, to allow the latch pins 118 to pass therebetween. The latch pins 118 are sufficiently close to the U-section sides of the distal end 50 of the lower stay arm as to rest upon the edges of those sides, thereby holding the torso stay in, or close to, the folded orientation shown in FIGS. 2 and 10. It will be seen that the above explanation of the function of the torso stay 68 is also applicable to the first torso stay 66, as the two torso stays 66 and 68 are physically identical to one another, as are the distal ends 48 and 50 of the various lower stay arms 40, 42, 108, and 110.

FIG. 8 provides an illustration of a second embodiment of the adjustable clothes hanger, designated as hanger 210. The hanger 210 is quite similar to the hanger 10 of FIGS. 1 through 3, with identical components being identified by identical reference numerals. The hanger 210 includes a frame 212 formed of mutually opposed first and second shoulder supports, respectively 14 and 16, similar to the first embodiment of FIGS. 1 through 3. The two shoulder supports have a common central end 18, with a hanger hook 20 extending therefrom. Each of the shoulder supports 14 and 16 slopes downwardly and outwardly to a distal end, as in the first embodiment shown in FIGS. 1 through 3, opposite their common central end 18. A horizontal crossmember 226 connects the two distal ends of the shoulder supports 14 and 16 with one another to complete the frame 212, which has a relatively low and wide triangular configuration generally similar to other conventional clothes hangers.

It will be noted that the crossmember 226 of the second embodiment of FIG. 8 differs somewhat from the crossmember 26 of the first embodiment of FIGS. 1 through 3, in that it includes a relatively narrower central area 228, rather than having a constant thickness throughout its length. This narrower central area 228 facilitates the installation and removal of the crossmember attachment fittings 44 and 46 of the two lower stay arms 40 and 42, as those fittings 44 and 46 need not be spread or distended to such a degree as required to fit over the larger diameter portions of the crossmember 226 or the larger diameter of the first embodiment crossmember 26. An intermediate reinforcement member 230 may be provided to connect the common center 18 of the first and second shoulder supports 14 and 16 to the narrower diameter central portion 228 of the horizontal crossmember 226, if desired, to strengthen and stiffen the narrower diameter area of the crossmember. Alternatively, more than one intermediate reinforcement member may be provided between the first and second shoulder supports and the crossmember, as shown in the third embodiment of FIGS. 9 through 11 and described further below. The remainder of the structure of the second embodiment adjustable clothes hanger 210 of FIG. 8 is identical to that structure described further above for the first embodiment hanger 10 of FIGS. 1 through 3, including the various attachments shown in FIGS. 4 through 7 and described further above.

FIGS. 9 through 12 illustrate a third embodiment of the adjustable clothes hanger, designated as hanger 310. The hanger 310 differs from the hangers 10 and 210 due to its frame 312 and the sleeve lower stays, which are extensions of the distal ends of the two sleeve upper stays rather than extending from the lower stay arms as in the first two embodiments. The hanger 310 includes a frame 312 (shown most clearly in FIG. 11) formed of mutually opposed first and second shoulder supports, respectively 314 and 316. The two shoulder supports have a common central area 318 therebetween, with a hanger hook 320 extending therefrom. The hanger hook 320 may be a separate component pivotally installed through a passage 321 through the central portion 318 of the frame 312, as shown in the exploded view of FIG. 11 of the drawings. It will be seen that this pivotally attached hanger hook configuration may be incorporated with the other embodiments of the hanger, if so desired. Each of the shoulder supports 314 and 316 slopes downwardly and outwardly to a distal end, as in the first embodiment shown in FIGS. 1 through 3, opposite their common central area 318. A horizontal crossmember 26, essentially identical to the crossmember 26 of the embodiment of FIGS. 1 through 3, connects the two distal ends of the shoulder supports 314 and 316 with one another to complete the frame 312, which has a relatively low and wide triangular configuration generally similar to other conventional clothes hangers.

The relatively wide central portion or area 318 of the frame 312 provides for the use of two laterally separated intermediate reinforcement members 329 and 331, with those reinforcement members extending from each end of the central portion or area 318 at the inboard ends of the two shoulder supports 314 and 316, to the crossmember 26. The two reinforcement members 329 and 331 are spaced sufficiently closely to allow the two lower stay arms 108 and 110 to be adjusted inwardly to any practicable extent necessary to position the depending torso stays 66 and 68 as required. It will be seen that the two reinforcement members 329 and 331 may also be used with the first embodiment hanger 10 of FIGS. 1 through 3, and/or the second embodiment hanger 210 of FIG. 8 if so desired.

First and second sleeve upper stays, respectively 328 and 330, are adjustably installed upon the respective first and second shoulder supports 314 and 316. These two sleeve upper stays 328 and 330 are adjustably attached to their respective underlying shoulder supports 314 and 316 in the same manner as described further above for the first embodiment hanger 10 and illustrated in FIG. 4 of the drawings. Each of the sleeve upper stays 328 and 330 has an inner or inboard end, respectively 332 and 334, and an opposite distal and depending outboard end, respectively 336 and 338, with these depending outer or distal ends being oriented substantially vertically when the hanger 310 is suspended freely from its hook.

Figure 12:
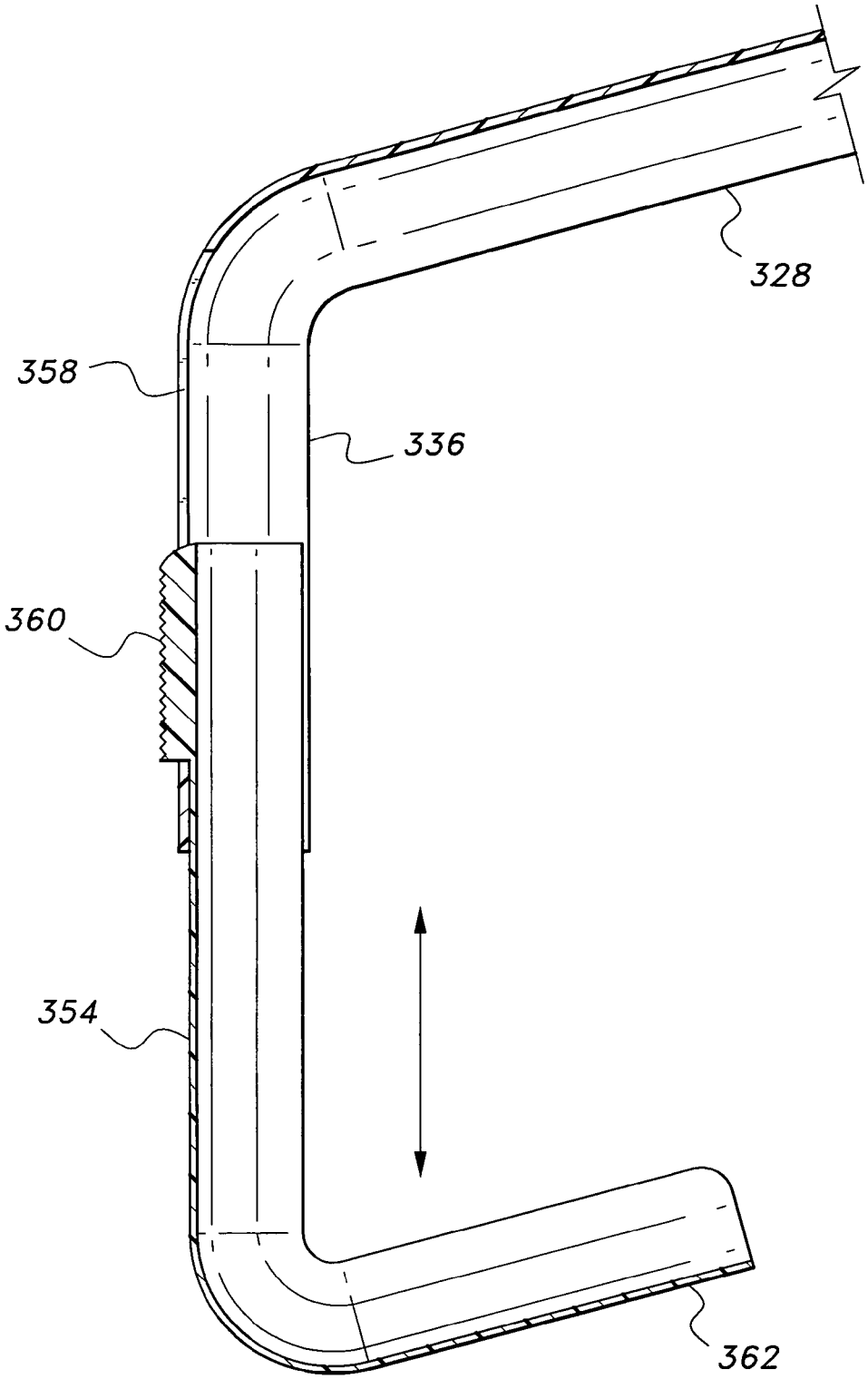
FIG. 12 is a detailed elevation view in section of the outer end of one of the adjustable shoulder supports of the adjustable clothes hanger of FIGS. 9 through 11, showing details of the adjustment of the sleeve lower stay.
Figure 13:
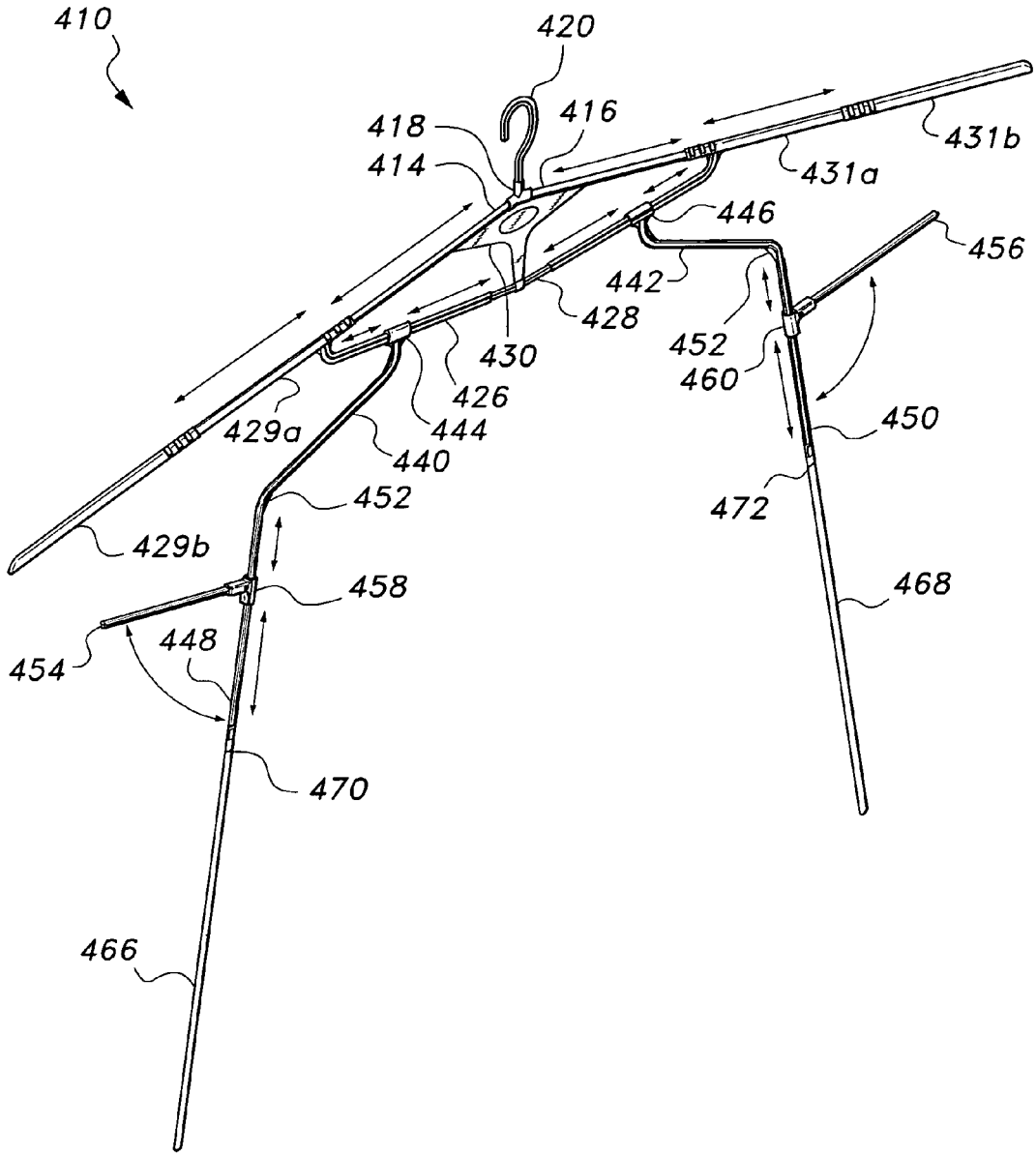
FIG. 13 is a perspective view of a fourth embodiment of an adjustable clothes hanger according to the present invention, wherein the lower sleeve stays are pivotally attached to their respective lower torso stays.
Figure 14:
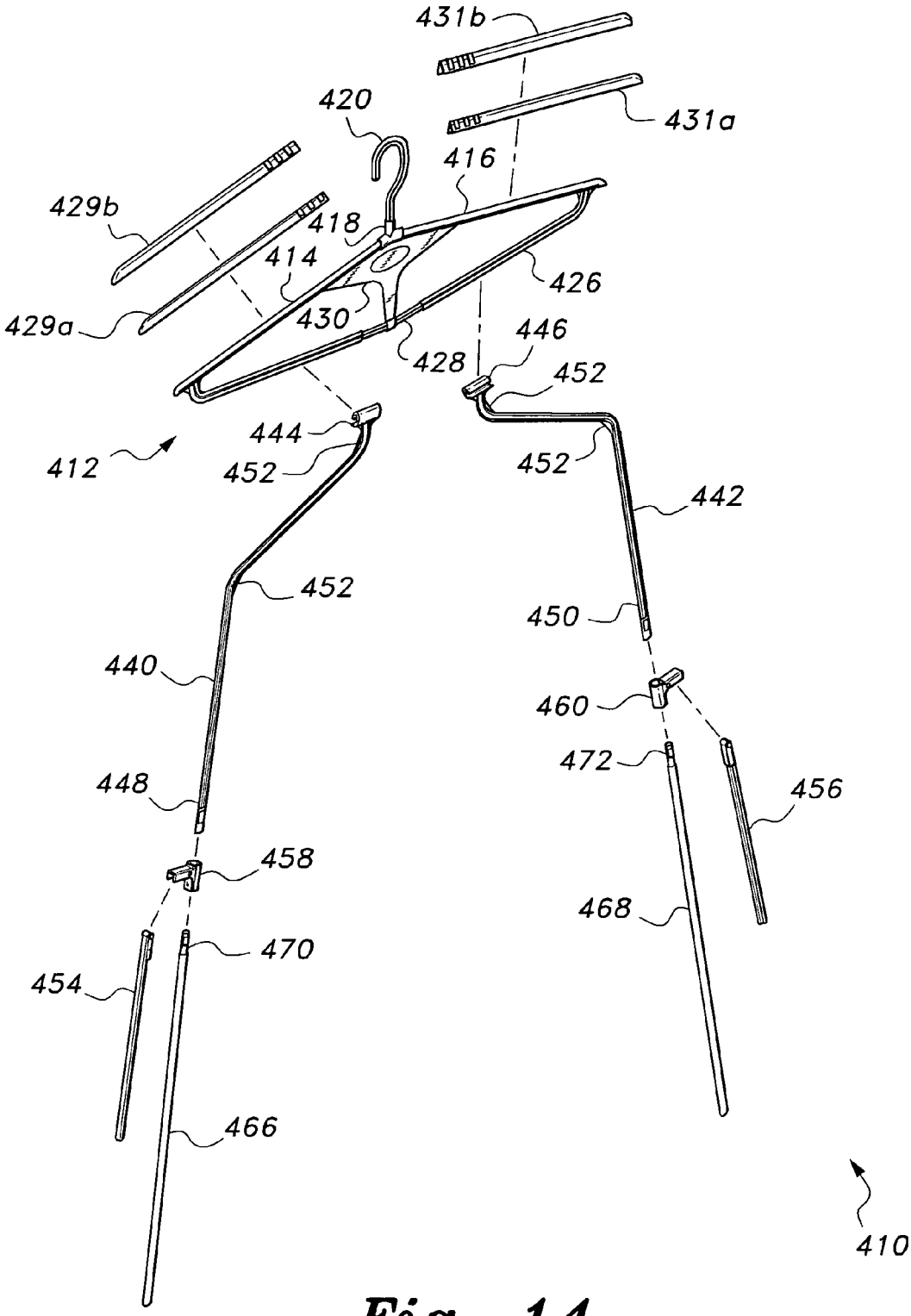
FIG. 14 is an exploded perspective view of the adjustable clothes hanger of FIG. 13, showing the assembly of the various components to one another.

Rather than providing sleeve lower stays extending from the lower portions of the first and second lower stay arms, as in the embodiments of FIGS. 1 through 3 and FIG. 8, the sleeve lower stays 354 and 356 extend adjustably from the downwardly oriented distal ends 336 and 338 of the two sleeve upper stays 328 and 330. FIG. 12 provides a detailed view in section of the distal end portion 336 of the first sleeve upper stay 328 and its telescoping first sleeve lower stay 354. Each of the downwardly oriented distal end portions 336 and 338 of the two sleeve upper stays 328 and 330 includes a longitudinal channel or slot 358 therein, with each of the sleeve lower stays 354 and 356 having an outwardly protruding tab 360 which travels within the channel 358. The vertically oriented upper portions of the sleeve lower stays are gripped frictionally between the two opposing sides of the generally U-section shape of the distal end portions 336 and 338 of the corresponding sleeve upper stay 328 and 330, with the outwardly protruding tab 360 allowing a user of the hanger 310 to adjust the positions of the lower stays 354 and 356 as desired. The lowermost or distal ends 362 and 364 of the two lower stays turn inwardly, and are oriented at least generally parallel to their respective sleeve upper stays in order to bear smoothly against the lower portion of a shirtsleeve placed thereon.

In consideration of the above described lower sleeve stay configuration of the embodiment 310 of FIGS. 9 through 12, it will be apparent that the lower sleeve stays extending from the lower portions of the lower stay arms of the embodiments 10 and 210 of FIGS. 1 through 3 and FIG. 8 are not necessary for the hanger 310. Accordingly, somewhat shorter lower stay arms 108 and 110 are provided for the hanger embodiment 310 of FIGS. 9 through 11. These shorter arms lack the extension portion for the attachment of the lower sleeve stays 54 and 56 of the embodiments 10 and 210, but their upper crossmember attachment ends 44 and 46 and opposite lowermost or distal ends 48 and 50 which provide for the pivotal or folding attachment of the torso stays 66 and 68 thereto, are identical to those components of the lower sleeve stays 54 and 56 of the embodiments 10 and 210. The second or right side shorter lower stay arm 110 is also shown in detail in FIG. 8, illustrating the crossmember attachment end 46 and the torso stay attachment details common to both types of lower stay arms. Details of the attachment of the lower stay arms to the hanger frame crossmember are illustrated in the cross sectional view of FIG. 5, and described in detail in the discussion of the first hanger embodiment 10 further above.

Figure 15:
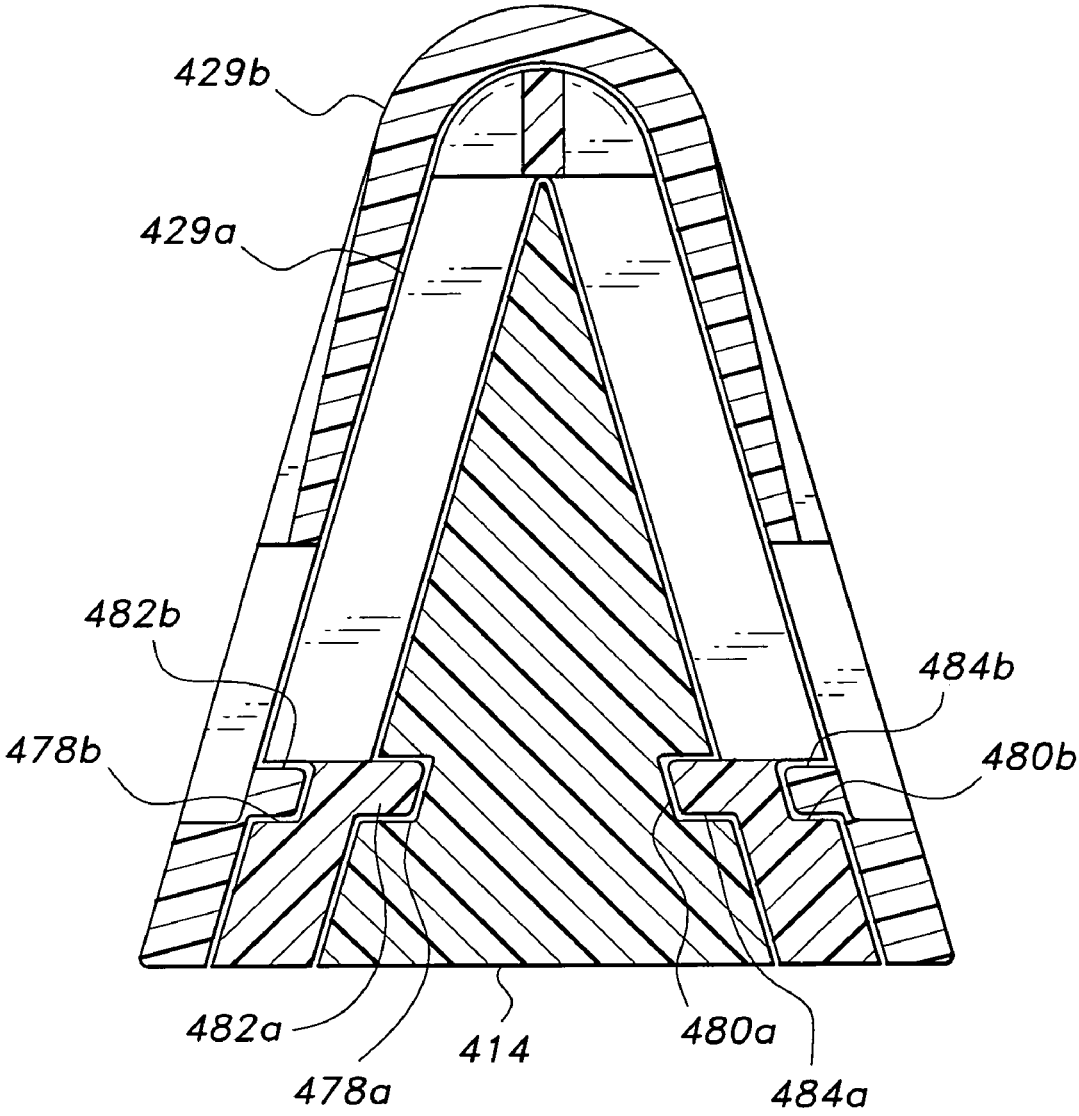
FIG. 15 is a detailed elevation view in section through one of the double telescoping shoulder stay extensions of the clothes hanger of FIG. 13, showing additional details thereof.

FIGS. 13 through 17 illustrate the general configuration and details of a fourth embodiment of the adjustable clothes hanger, designated as hanger 410. The hanger 410 is somewhat similar to the hanger 210 of FIG. 8, but differs in various aspects. The hanger 410 includes a frame 412 formed of mutually opposed first and second shoulder supports, respectively 414 and 416, similar to the first embodiment of FIGS. 1 through 3. The two shoulder supports serve the same function as the shoulder supports 14 and 16 of the previously discussed embodiments, but have a different cross sectional shape as shown in FIG. 15 and discussed further below. However, the cross sectional shape is not critical to the invention, and may be adjusted as desired or interchanged between different embodiments.

The two shoulder supports 414 and 416 have a common central end 418, with a hanger hook 420 extending therefrom. Each of the shoulder supports 414 and 416 slopes downwardly and outwardly to a distal end, as in the first embodiment shown in FIGS. 1 through 3, opposite their common central end 418. A crossmember 426 connects the two distal ends of the shoulder supports 414 and 416 with one another to complete the frame 412, which has a relatively low and wide triangular configuration generally similar to other conventional clothes hangers.

It will be noted that the crossmember 426 of the second embodiment of FIG. 8 differs somewhat from the crossmember 26 of the first embodiment of FIGS. 1 through 3, in that it includes a relatively narrower central area 428, rather than having a constant thickness throughout its length. This narrower central area 428 facilitates the installation and removal of the crossmember attachment fittings 444 and 446 of the two lower stay arms 440 and 442, as those fittings 444 and 446 need not be spread or distended to such a degree as required to fit over the larger diameter portions of the crossmember 426 or the larger diameter of the first embodiment crossmember 26. An intermediate reinforcement member 430 may be provided to connect the common center 418 of the first and second shoulder supports 414 and 416 to the narrower diameter central portion 428 of the horizontal crossmember 426, if desired, to strengthen and stiffen the narrower diameter area of the crossmember. Alternatively, more than one intermediate reinforcement member may be provided between the first and second shoulder supports and the crossmember, as shown in the third embodiment of FIGS. 9 through 11 and described further below. It will be noted that the intermediate reinforcement member 430 is somewhat longer or deeper than the corresponding components of other embodiments, with the two portions of the crossmember 426 forming a shallow V or angle therebetween at their mutual center point where they join the intermediate reinforcement member 430.

The adjustable clothes hanger 410 of FIGS. 13 through 17 differs from other embodiments in that the first and second sleeve upper stays each comprise multiple lengths or sections, with each sleeve upper stay assembly comprising an intermediate upper stay section, respectively 429*a* and 431*a*, and an outboard or distal upper stay section, respectively 429*b* and 431*b*. The intermediate stay sections 429*a*, 431*a* slide coaxially along their respective shoulder supports 414 and 416, with the outboard or distal stay sections 429*b* and 431*b* sliding coaxially respectively along their respective intermediate stay sections 429*a* and 431*a*. Thus, the upper sleeve stays of the adjustable hanger of FIGS. 13 and 14 may be extended to a considerably greater length than the single adjustable stays of the other embodiments, to provide greater support for wider shoulders and longer sleeves.

First and second lower stay arms, respectively 440 and 442, have generally semicylindrical crossmember attachment ends or fittings, respectively 444 and 446, which adjustably attach to the crossmember 426 in substantially the same manner as described further above for the corresponding components of previous embodiments. The two lower stay arms 440 and 442 are preferably identical to one another, but secure to the crossmember 426 from opposite sides thereof to produce the substantially mirror image, mutually outwardly bowed assembly shown in FIGS. 13 and 14 of the drawings. Each lower stay arm 440 and 442 has a distal end, respectively 448 and 450, providing for the attachment of first and second torso stays thereto as shown in the various drawing Figs. and described in detail further below. The opposite ends of each of the two lower stay arms 440 and 442 are preferably axially offset from one another in order to spread the lower portion with its distal end farther outward from its attachment end, in order to better spread the torso of the shirt by means of the torso stays depending therefrom as described further above for previous embodiments. A reinforcement web 452 may be provided at each angular bend of the lower stay arms 440 and 442, to strengthen the two stay arms. These reinforcement webs are optional, and are accordingly shown in solid or broken lines in various drawing Figs. and omitted in others. They may be incorporated or omitted in any of the embodiments, as desired.

Figure 17:
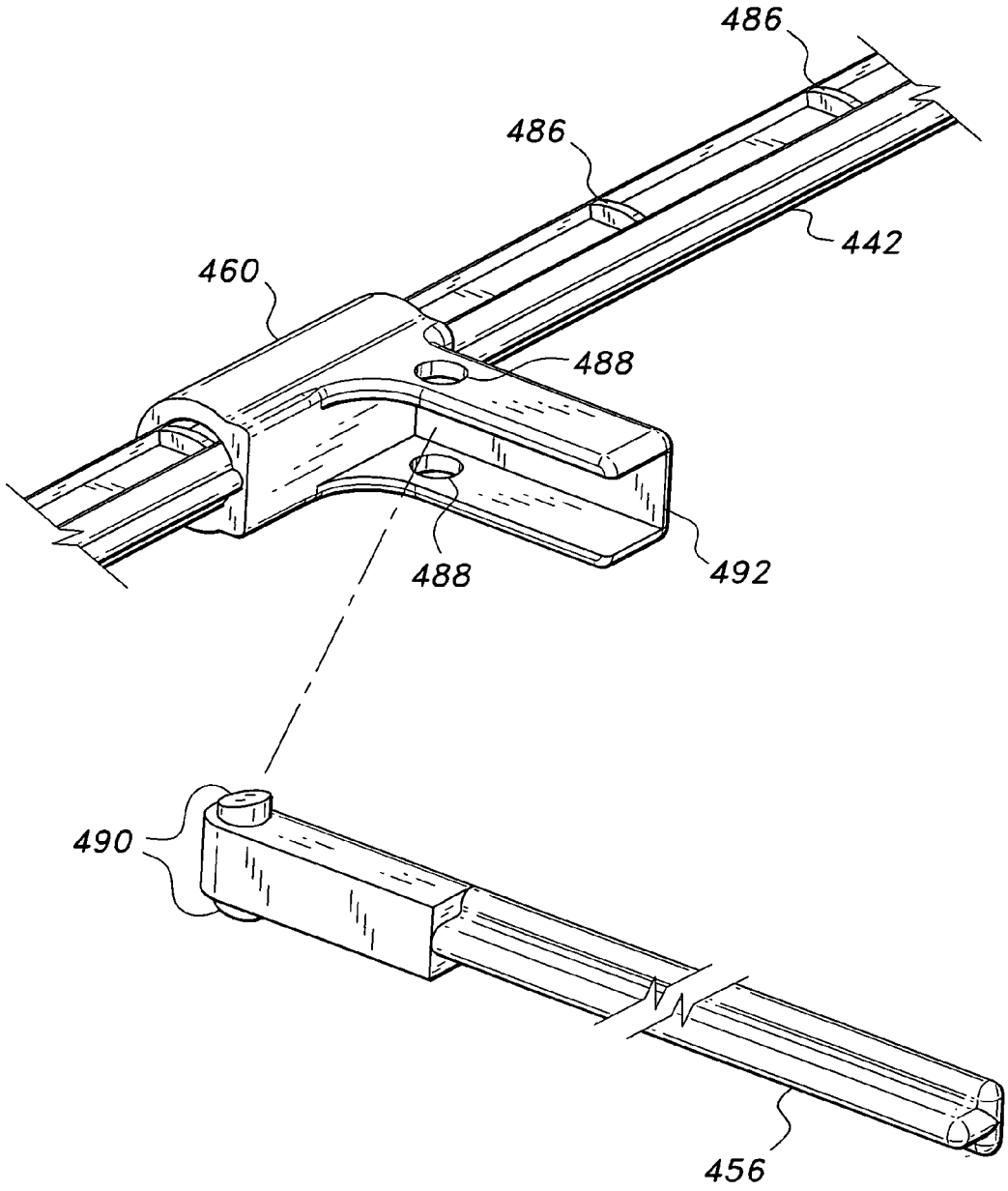
FIG. 17 is a detailed exploded perspective view of the lower sleeve stay assembly of the clothes hanger of FIG. 13 from below, showing additional details thereof.

Each of the two lower stay arms 440 and 442 has a sleeve lower stay, respectively 454 and 456, adjustably attached thereto and extending therefrom. The two sleeve lower stays 454 and 456 are identical to one another, but attach to and extend from their respective lower stay arms 440 and 442 in opposite, substantially mirror image deployment, similarly to the installation of the two identical lower stay arms 440 and 442 upon the crossmember 426. Each of the sleeve lower stays 454 and 456 includes a lower stay arm attachment end fitting, respectively 458 and 460, slidably and adjustably installed upon the respective lower stay arm. Details of the sleeve lower stay attachment to the lower stay arm are shown in FIG. 17 and described in detail further below. The two sleeve lower stays 454 and 456 are adjustable upwardly and downwardly along their respective lower stay arms 440 and 442 by means of their attachment end fittings 458 and 460, and extend pivotally from their respective first and second end fittings 458 and 460. In this manner, the sleeve lower stays may be raised or lowered to adjust for the widths of the shirtsleeves placed thereon, to spread them for proper drying and to greatly reduce or eliminate the formation of wrinkles in the shirtsleeves. Details of the pivotal attachment of the sleeve lower stays 454, 456 to their respective fittings 458, 460 are shown in FIG. 17 and discussed further below.

Each of the lower stay arms 440 and 442 further includes a torso stay, respectively 466 and 468, attached to and extending from its distal end 448 and 450. Each torso stay includes a lower stay arm attachment end, respectively 470 and 472, and an opposite distal end. The torso stays are preferably sufficiently long to extend completely along the sides of the torso of a shirt to spread the torso for drying and to eliminate or reduce wrinkling. The attachment of each torso stay 466, 468 to its respective lower stay arm 440, 442 is shown in detail in FIG. 16 and discussed in detail further below.

Figure 16:
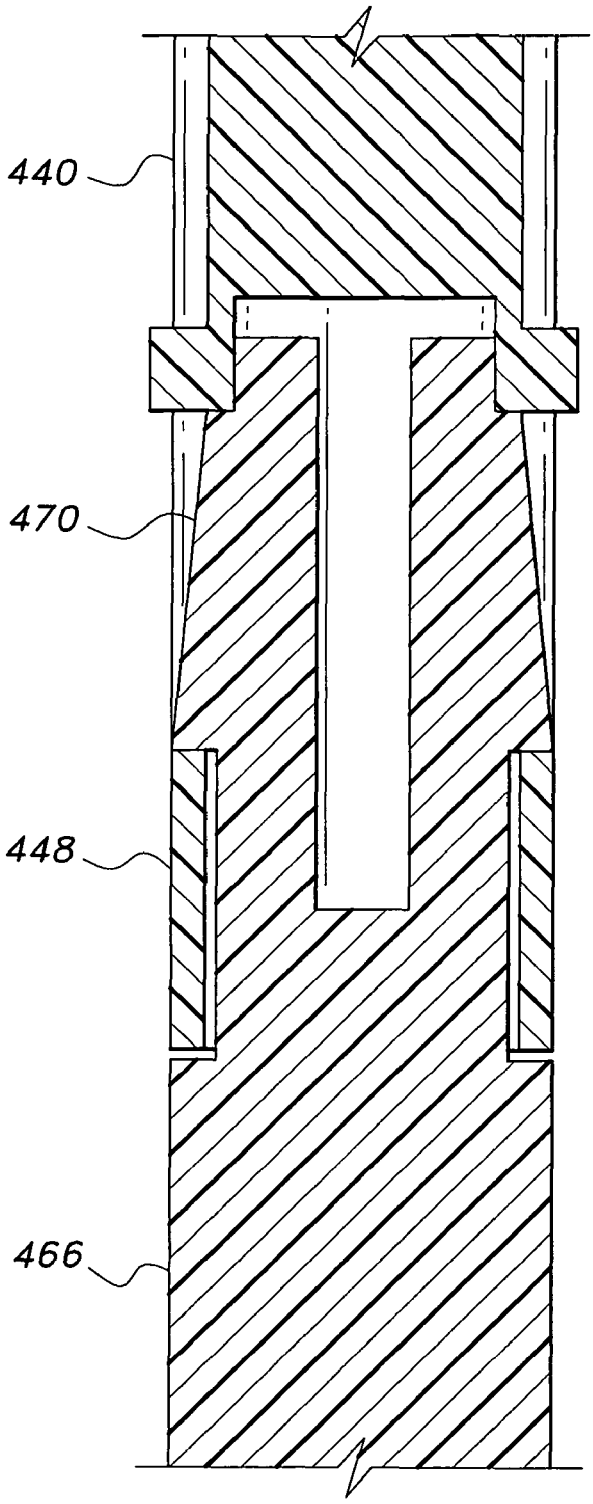
FIG. 16 is a detailed elevation view in section through one of the torso stay joint assemblies of the clothes hanger of FIG. 13, showing additional details thereof.

FIGS. 15 through 17 illustrate details of the adjustable attachment of various components to one another. FIG. 15 is a view in section through e.g. the first shoulder support 414 with its respective intermediate and distal upper sleeve stays 429*a* and 429*b* retracted thereon. It will be seen that a section through the opposite second shoulder support 416 with its two adjustable stays 431*a* and 431*b* retracted thereon, would produce a substantially similar view.

The shoulder support 414 includes opposed first and second longitudinal channels, respectively 478*a* and 480*a*, with the opposite edges of the corresponding intermediate sleeve upper stay 429*a* having inwardly extending tabs, respectively 482*a* and 484*a*, which engage the corresponding channels 478*a* and 480*a*. The tabs 482*a* and 484*a* retain the sleeve upper stay 429*a* on the shoulder support 414, yet allow the sleeve upper stay to slide longitudinally along the shoulder support to adjust the span of the intermediate sleeve upper stay 429*a* desired. The sleeve upper stays are held in position along their respective shoulder supports by a series of detents (not shown in FIG. 15, but similar to the detents 86 shown in FIG. 4) disposed within either or both of the channels 478*a* and 480*a* of the shoulder supports 414 and 416.

In a similar manner, the intermediate sleeve upper stay 429*a* includes opposed channels 478*b* and 480*b* formed therein, with corresponding tabs 482*b* and 484*b* extending inwardly from the outboard or distal sleeve upper stay 429*b* to engage the intermediate sleeve upper stay channels 478*b*, 480*b*. Again, appropriate detents may be provided to lock the position of the outboard sleeve upper stay as desired relative to the intermediate sleeve upper stay. The use of flexible materials, such as a durable plastic, provides sufficient flexibility to allow parts to bend and flex relative to one another in order to be adjusted past the detents as desired.

FIG. 16 is an illustration of the connection between the distal attachment end 448 of the first lower stay arm 440 and the attachment end of its corresponding first torso stay 466. As in the case of the exemplary first shoulder stay assembly shown in FIG. 15 and discussed immediately above, the attachment configuration for the second lower stay arm 442 and its second torso stay 468 is identical to that shown in FIG. 16 for the first lower stay arm 440 and its first torso stay 466. The distal end of the lower stay arm 440 defines a concentric socket therein, with spaced circumferential openings or passages therethrough. The mating attachment end 470 of the torso stay 466 includes a series of tapered fingers, each of which has an abrupt lip or edge at its proximal end. The fingers of the torso stay 466 insert into the mating socket of the lower stay arm, and protrude through the circumferential openings of the distal end of the lower stay arm. The lips or edges of the fingers are captured by the distal edges of the openings, preventing the torso stay from being withdrawn from the lower stay arm unless the fingers are pressed inwardly to clear the edges of the openings.

FIG. 17 provides an exploded perspective view to show the pivotal attachment of the second sleeve lower stay 456 to its respective lower stay arm attachment fitting 460. The first sleeve lower stay and its stay arm attachment fitting are identical to the components shown in FIG. 17. The attachment fitting 460 slides longitudinally along the lower length of its lower stay arm 442, with a series of stops or detents 486 disposed along the lower portion of the lower stay arm to hold the fitting 460 in position as desired. The flexible nature of the material from which the components of the adjustable hanger are formed allow the various components to be repositioned relative to one another while momentarily deforming the detents or other structure, as described further above for the adjustment of the shoulder supports and other structure.

The attachment fitting 460 further includes two mutually opposed passages or receptacles 488, with the attachment end of the sleeve lower stay 456 having two opposed buttons or protrusions 490 that engage the passages 488 of the fitting 460. The buttons or protrusions are tapered to facilitate installation of the sleeve lower stay to its attachment fitting. The somewhat flexible plastic material of which the components of the adjustable clothes hanger are formed allow for the distension or spreading of the two opposite sides of the U-section portion of the fitting 460, to allow the buttons 490 of the sleeve lower stay 456 to pass therebetween. This means of attachment permits the sleeve lower stay 456 to pivot relative to its attachment fitting, thereby allowing the stay to fold for compact storage and also providing adjustment for the size of the sleeve when a shirt is placed on the hanger. The central portion 492 of the U-shaped section of the fitting 460 serves as a stop to limit upward motion of the sleeve lower stay 456, in order to hold a shirt sleeve fully spread when a shirt is placed upon the hanger.

In conclusion, the adjustable clothes hanger in its various embodiments provides a means for the owner of costly garments to care for such garments properly. The numerous adjustments possible with the adjustable hanger assure that a shirt or similar garment placed thereon, will be properly shaped during any drying or storage to remain free of wrinkles and ready for the next wearing. The savings in time and energy by avoiding the necessity of ironing such shirts and garments, will be much appreciated by those who own and wear such garments.

It is to be understood that the present invention is not limited to the embodiments described above, but encompasses any and all embodiments within the scope of the following claims.

I claim:

1. An adjustable clothes hanger, comprising:

first and second shoulder supports, each of the shoulder supports having a central end and a distal end opposite the central end sloping downwardly and outwardly from the central end;

a horizontal crossmember connecting the distal end of each of the shoulder supports to one another, the first and second shoulder supports and the horizontal crossmember defining a low and wide triangular frame;

at least one first laterally adjustable sleeve upper stay and at least one second laterally adjustable sleeve upper stay, each sleeve upper stay having an inner end and a distal end opposite the inner end, each sleeve upper stay being slidably adjustable along the respective shoulder supports;

first and second lower stay arms, each of the lower stay arms having a crossmember attachment end slidably disposed upon the crossmember and a distal end opposite the crossmember attachment end;

a sleeve lower stay having a lower stay arm attachment end slidably disposed upon the respective lower stay arm, the sleeve lower stays having a distal end;

mutually opposed first and second channels disposed longitudinally along the first and second shoulder support, horizontal crossmember, and first and second lower stay arm;

mutually opposed first and second tabs extending inwardly from each sleeve upper stay and the crossmember attachment end of each lower stay arm, respectively engaging the corresponding channels of the first and second shoulder support and horizontal crossmember; and a tab extending inwardly from the lower stay arm attachment end of each sleeve lower stay, respectively engaging one of the channels of each lower stay arm.

2. The adjustable clothes hanger according to claim 1, wherein the first and the second sleeve upper stay each comprise an intermediate sleeve upper stay and a distal sleeve upper stay.

3. The adjustable clothes hanger according to claim 1, wherein each sleeve lower stay is pivotally attached to the respective lower stay arm.

4. The adjustable clothes hanger according to claim 1, further including a first and a second torso stay extending respectively from the distal end of the first and second lower stay arm.

5. The adjustable clothes hanger according to claim 4, wherein each torso stay is pivotally attached to the distal end of the respective lower stay arm.

6. The adjustable clothes hanger according to claim 1, further including at least one detent disposed in at least one of the channels of the first and second shoulder support, horizontal crossmember, and first and second lower stay arm.

7. The adjustable clothes hanger according to claim 1, further including at least one intermediate reinforcement member connecting the first and second shoulder support to the horizontal crossmember.

8. An adjustable clothes hanger, comprising:

first and second shoulder supports, each of the shoulder supports having a central end and a distal end opposite the central end sloping downwardly and outwardly from the central end;

a horizontal crossmember connecting the distal end of each of the shoulder supports to one another, the first and second shoulder supports and the horizontal crossmember defining a low and wide triangular frame;

at least one first laterally adjustable sleeve upper stay and at least one second laterally adjustable sleeve upper stay, each sleeve upper stay having an inner end and a distal end opposite the inner end, each sleeve upper stay being slidably adjustable along the respective shoulder supports;

first and second vertically adjustable sleeve lower stays slidably disposed upon the distal end of the respective sleeve upper stays;

mutually opposed first and second channels disposed longitudinally along the first and second shoulder support and horizontal crossmember;

mutually opposed first and second tabs extending inwardly from each sleeve upper stay and the crossmember attachment end of each lower stay arm, respectively engaging the corresponding channels of the first and second shoulder support and horizontal crossmember; and the first and second sleeve lower stay telescopically disposed within the distal end of the respective sleeve upper stay.

9. The adjustable clothes hanger according to claim 8, wherein the first and the second sleeve upper stay each comprise an intermediate sleeve upper stay and a distal sleeve upper stay.

10. The adjustable clothes hanger according to claim 9, further including:

a first and a second lower stay arm, each having a crossmember attachment end slidably disposed upon the crossmember and a distal end opposite the crossmember attachment end; and a first and a second torso stay extending respectively from the distal end of the first and second lower stay arm.

11. The adjustable clothes hanger according to claim 10, wherein each torso stay is pivotally attached to the distal end of the respective lower stay arm.

12. The adjustable clothes hanger according to claim 8, further including:

at least one detent disposed in at least one of the channels of the first and second shoulder support and horizontal crossmember;

a channel disposed longitudinally along the distal end of each sleeve upper stay; and a tab extending outwardly from each sleeve lower stay, engaging the respective channel of each sleeve upper stay.

13. The adjustable clothes hanger according to claim 8, further including at least one intermediate reinforcement member connecting the first and second shoulder support to the horizontal crossmember.

14. An adjustable clothes hanger, comprising:

first and second shoulder supports, each of the shoulder supports having a central end and a distal end opposite the central end sloping downwardly and outwardly from the central end;

a horizontal crossmember connecting the distal end of each of the shoulder supports to one another, the first and second shoulder supports and horizontal crossmember defining a low and wide triangular frame;

first and second lower stay arms, each of the lower stay arms having a crossmember attachment end slidably disposed upon the crossmember and a distal end opposite the crossmember attachment end;

a folding torso stay pivotally attached to, and depending from, the distal end of the respective lower stay arms;

at least one first laterally adjustable sleeve upper stay and at least one second laterally adjustable sleeve upper stay, each sleeve upper stay having an inner end and a distal end opposite the inner end, each sleeve upper stay being slidably adjustable along the respective shoulder supports;

a sleeve lower stay having a lower stay arm attachment end slidably disposed upon the respective lower stay arm, and a distal end;

mutually opposed first and second channels disposed longitudinally along the first and second shoulder support, horizontal crossmember, and first and second lower stay arm;

mutually opposed first and second tabs extending inwardly from each sleeve upper stay and the crossmember attachment end of each lower stay arm, respectively engaging the corresponding channels of the first and second shoulder support and horizontal crossmember; and a tab extending inwardly from the lower stay arm attachment end of each sleeve lower stay, respectively engaging one of the channels of each lower stay arm.

15. The adjustable clothes hanger according to claim 14, wherein the first and the second sleeve upper stay each comprise an intermediate sleeve upper stay and a distal sleeve upper stay.

16. The adjustable clothes hanger according to claim 14, wherein each sleeve lower stay is pivotally attached to the respective lower stay arm.

17. The adjustable clothes hanger according to claim 14, further including at least one detent disposed in at least one of the channels of the first and second shoulder support, horizontal crossmember, and first and second lower stay arm.

18. The adjustable clothes hanger according to claim 14, further comprising:

a first and a second laterally adjustable sleeve upper stay, each having an inner end and a distal end opposite the inner end and adjusting slidably along the respective shoulder support; and a first and a second vertically adjustable sleeve lower stay slidably disposed upon the distal end of the respective sleeve upper stay.

19. The adjustable clothes hanger according to claim 18, further including:

mutually opposed first and second channels disposed longitudinally along the first and second shoulder support and horizontal crossmember;

mutually opposed first and second tabs extending inwardly from each sleeve upper stay and the crossmember attachment end of each lower stay arm, respectively engaging the corresponding channels of the first and second shoulder support and horizontal crossmember; and the first and second sleeve lower stay telescopically disposed within the distal end of the respective sleeve upper stay.

20. The adjustable clothes hanger according to claim 19, further including:

at least one detent disposed in at least one of the channels of the first and second shoulder support and horizontal crossmember;

a channel disposed longitudinally along the distal end of each sleeve upper stay; and a tab extending outwardly from each sleeve lower stay, engaging the respective channel of each sleeve upper stay.

21. The adjustable clothes hanger according to claim 14, further including at least one intermediate reinforcement member connecting the first and second shoulder support to the horizontal crossmember.

* * * * *